US008157401B2

(12) United States Patent
Lau

(10) Patent No.: US 8,157,401 B2
(45) Date of Patent: Apr. 17, 2012

(54) LED RECHARGEABLE HEADLAMP

(76) Inventor: Chi Hung Fermi Lau, Kowloon (HK)

( * ) Notice: Subject to any disclaimer, the term of this patent is extended or adjusted under 35 U.S.C. 154(b) by 71 days.

(21) Appl. No.: 12/386,809

(22) Filed: Apr. 22, 2009

(65) Prior Publication Data

US 2010/0177503 A1 Jul. 15, 2010

Related U.S. Application Data

(60) Provisional application No. 61/204,949, filed on Jan. 12, 2009.

(51) Int. Cl.
*F21V 21/084* (2006.01)

(52) U.S. Cl. ..... 362/105; 362/194

(58) Field of Classification Search ..... 362/103, 362/105–107, 164, 183, 184, 190, 191, 212, 362/194
See application file for complete search history.

(56) References Cited

U.S. PATENT DOCUMENTS

| | | | | |
|---|---|---|---|---|
| 3,250,909 | A * | 5/1966 | Oldenburger | 362/205 |
| 6,877,875 | B2 * | 4/2005 | Yu et al. | 362/105 |
| 2003/0067769 | A1 * | 4/2003 | Gilpin | 362/184 |
| 2005/0002186 | A1 * | 1/2005 | Krieger et al. | 362/183 |
| 2005/0157492 | A1 * | 7/2005 | Chiu | 362/184 |

* cited by examiner

*Primary Examiner* — Julie Shallenberger
(74) *Attorney, Agent, or Firm* — Raymond Y. Chan; David and Raymond Patent Firm

(57) ABSTRACT

A LED rechargeable headlamp includes a light head, a rechargeable power source, a head mount and a rechargeable dock. The light head includes a light housing having a light window, and a LED light source supported in the light housing to align with the light window. The head mount is movably coupled with the light housing to selectively adjust a light projecting orientation of the LED light source through the light window. The rechargeable dock, which is adapted for electrically connecting with an external power supply, has a docking cavity detachably receiving the light to charge the rechargeable power source.

3 Claims, 7 Drawing Sheets

LED RECHARGEABLE HEADLAMP

CROSS REFERENCE OF RELATED APPLICATION

This is a non-provisional application of a provisional application having an application No. 61/204,949 and a filing date of Jan. 12, 2009.

BACKGROUND OF THE PRESENT INVENTION

1. Field of Invention

The present invention relates to a lamp, and more particularly to a LED rechargeable headlamp comprising a head mount and a rechargeable dock which are capable of allowing convenient adjustment of an angle of inclination of a light head and recharging thereof respectively.

2. Description of Related Arts

A conventional headlamp typically comprises a housing, a power source provided within the housing and an illuminating unit mounted in the housing and electrically connected with the power source, wherein the housing is adapted for wearing on a user's head through a strap so that a user is able to wear the headlamp on his or her head for providing illumination when he or she is performing some duties or personal work.

There several disadvantages for this kind of conventional headlamp. First, the headlamp must be affixed to the strap before it can be worn on the user's head. The conventional method is to affix the housing to the strap with little or no room for the housing to move with respective to the strap. In other words, when the housing is affixed to the strap, the illuminating angle of the illuminating unit cannot be freely adjusted. This present a great due of inconvenience to the user because when the user is wearing the headlamp on his or her head and he or she is in the course of performing some tasks, and when the user needs to adjust the angle of illumination so that he or she can view a particular object more clearly, the user has no choice but to either move his or her head to acquire the necessary angle of illumination, or detach the headlamp from his or her head and re-adjust the angle of inclination between the headlamp and the strap. Even this, the latter option may not be available because conventional headlamp may not provide connectors which facilitate pivotal movement between the housing or illumination unit with respective to the strap.

Second, recharging issues of conventional headlamp presents another disadvantage. For conventional headlamp, in order to recharge, the user has to detach the rechargeable battery for recharging. This also induces a great due of inconvenience to the user. When the rechargeable battery is detached from the headlamp, the user has to utilize designated charging equipment, such as a predetermined charger, for charging the rechargeable battery. Very often, however, the charger and the headlamp are separately located so that one may not be able to get the predetermined charger quick enough to resume the operation of the headlamp promptly.

SUMMARY OF THE PRESENT INVENTION

A main object of the present invention is to provide a LED rechargeable headlamp comprising a head mount and a rechargeable dock which are capable of allowing convenient adjustment of an angle of inclination of a light head and recharging thereof respectively Another object of the present invention is to provide a LED rechargeable headlamp comprising a head mount which allows the headlamp to be pivotally adjustable for a user to freely adjust the orientation of the illumination produced by the LED rechargeable headlamp.

Another object of the present invention is to provide a LED rechargeable headlamp comprising a rechargeable dock which is adapted to receive and electrically connect to a light head so as to allow recharging of the light head by electrically connecting the rechargeable dock to an external power source, such as an external AC power source.

Another object of the present invention is to provide a LED rechargeable headlamp, wherein the rechargeable dock and the head mount are arranged to couple with a light head to form a single compact unit, so that the user is able to carry and use the LED rechargeable headlamp in a convenient and efficient manner.

Another object of the present invention is to provide a LED rechargeable headlamp, which does not substantially alter the traditional structure of the light head, so as to minimize the manufacturing cost of the present invention, and to facilitate widespread application of the present invention.

Accordingly, in order to accomplish the above objects, the present invention provides a LED rechargeable headlamp, comprising:

a light head comprising a light housing having a light window, and a LED light source supported in the light housing to align with the light window;

a rechargeable power source supported in the light housing;

a head mount movably coupling with the light housing to selectively adjust a light projecting orientation of the LED light source through the light window; and a rechargeable dock, which is adapted for electrically connecting with an external power supply, having a docking cavity detachably receiving the light to charge the rechargeable power source.

These and other objectives, features, and advantages of the present invention will become apparent from the following detailed description, the accompanying drawings, and the appended claims.

DETAILED DESCRIPTION OF THE PREFERRED EMBODIMENT

Figure 1:
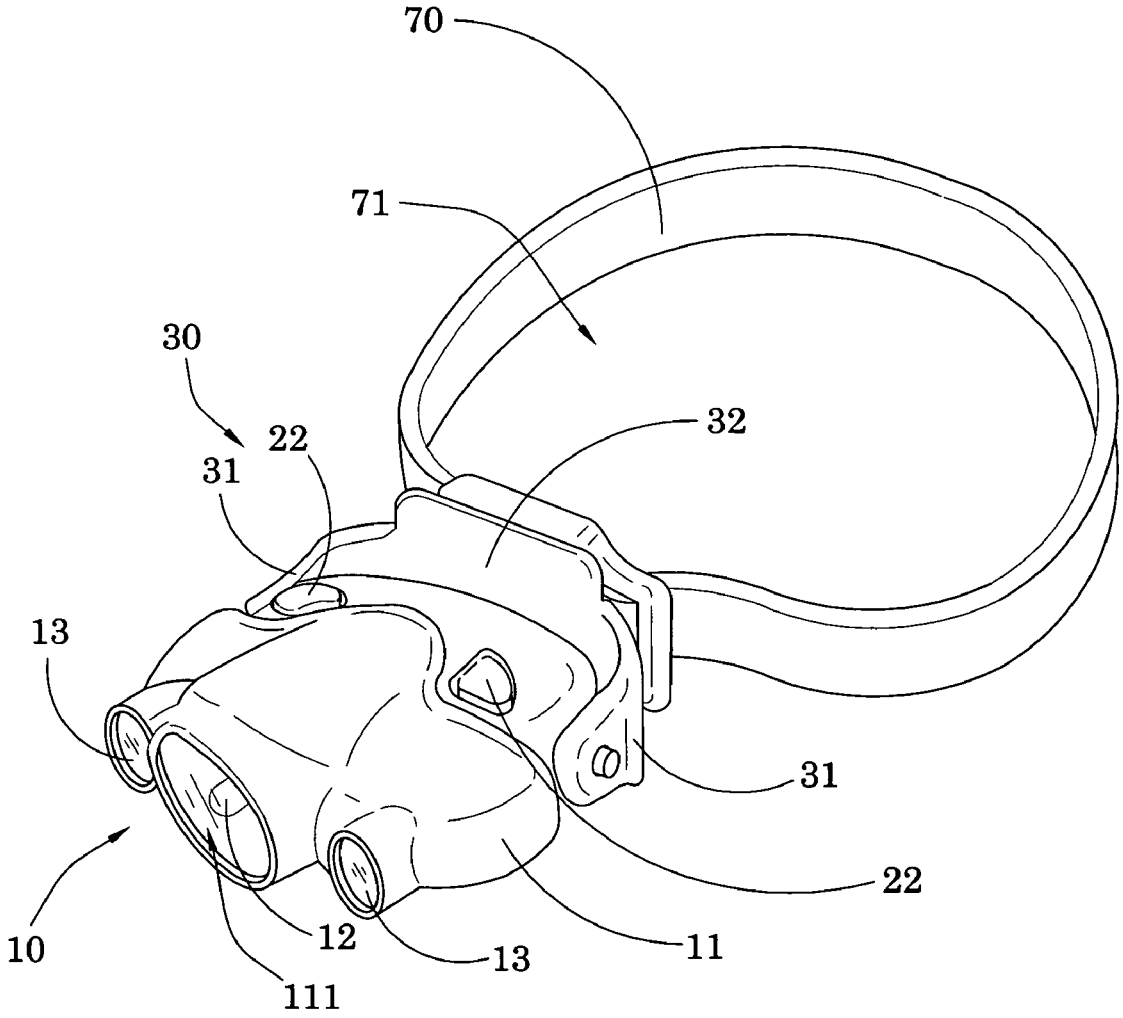
FIG. 1 is a perspective view of a LED rechargeable headlamp according to a preferred embodiment of the present invention.
Figure 2A:
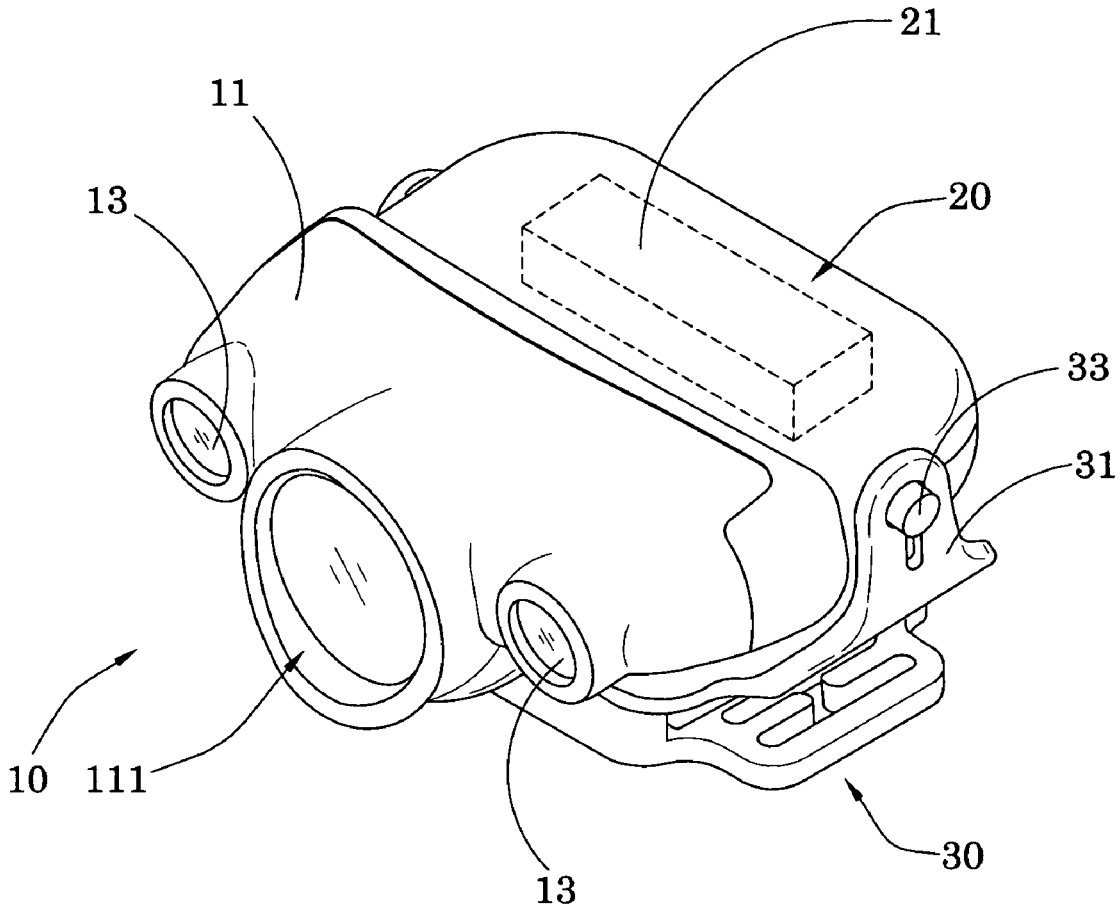
FIG. 2A and FIG. 2B are schematic diagrams of the LED rechargeable headlamp according to the above preferred embodiment of the present invention, illustrating that the head mount is mounted on the light head.
Figure 2B:
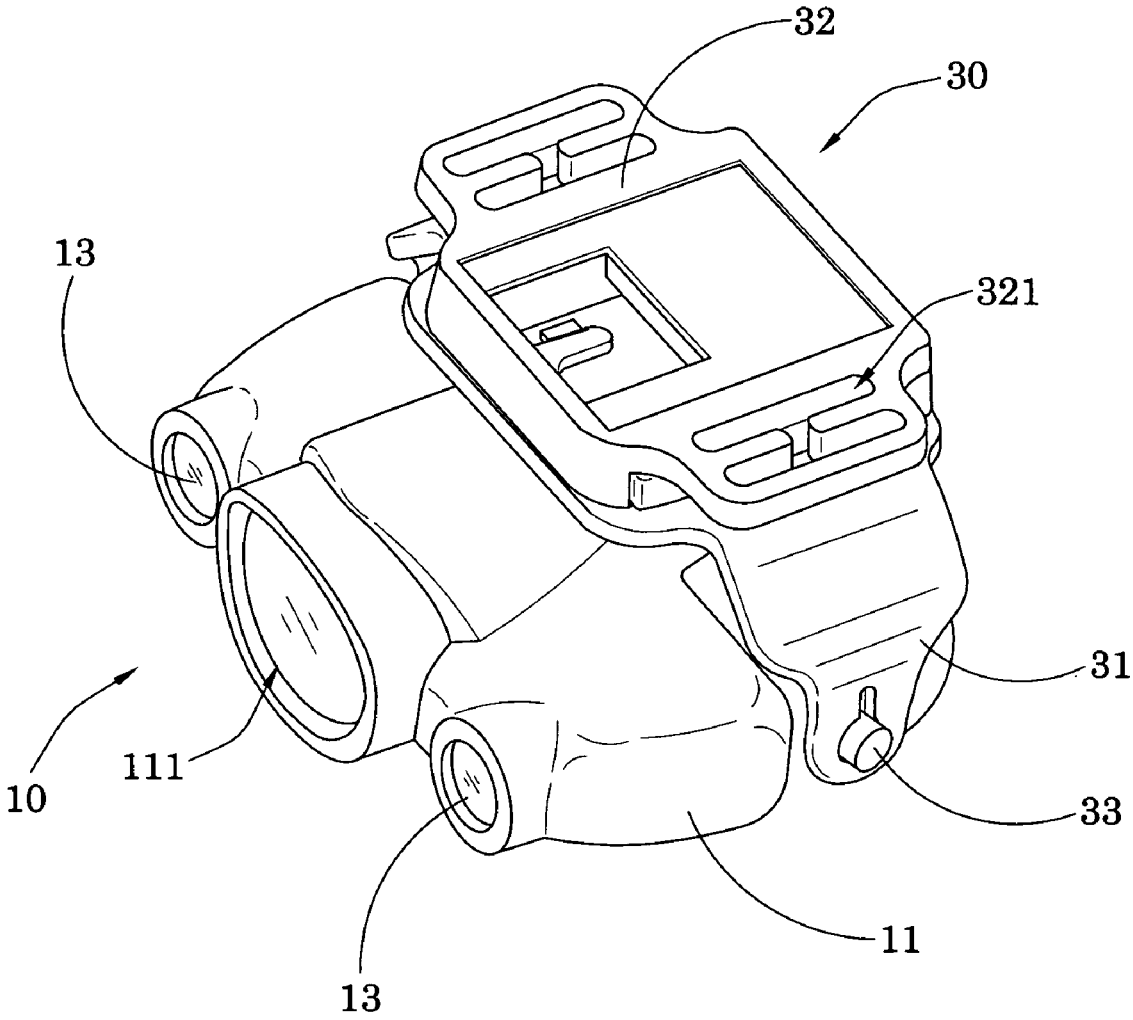
Figure 3A:
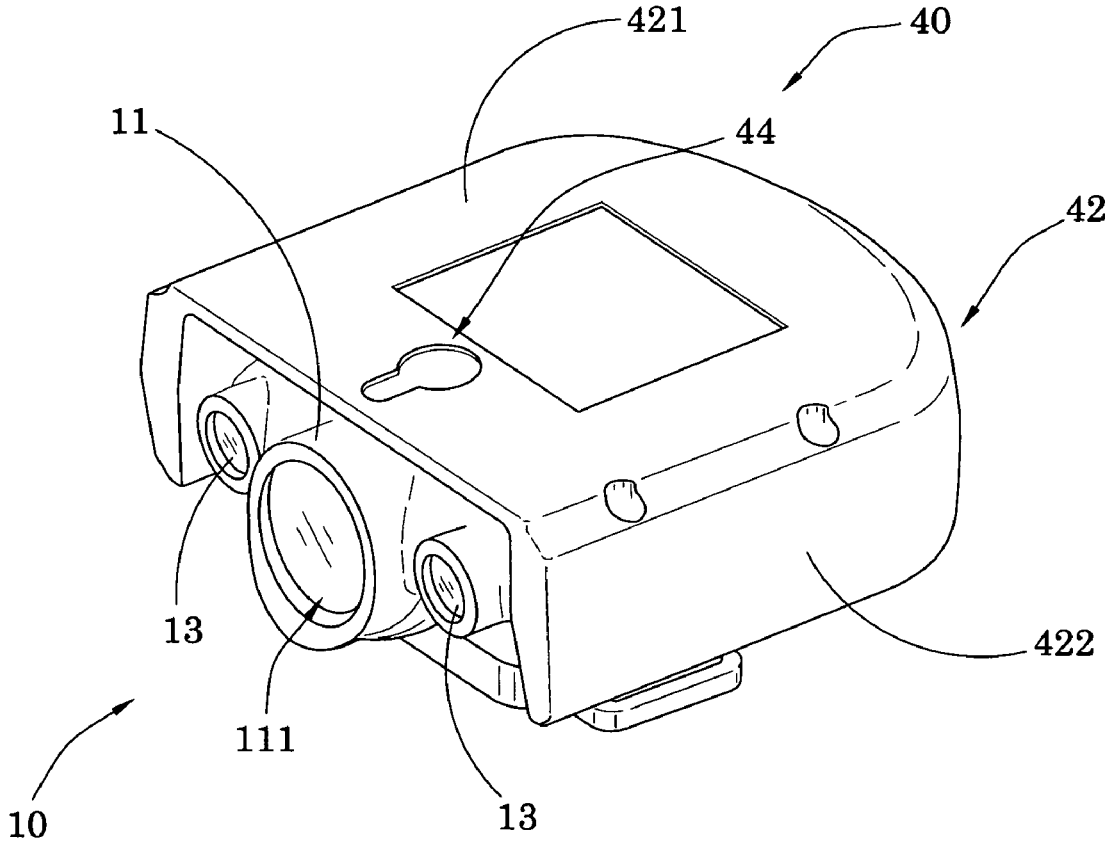
FIG. 3A and FIG. 3B are schematic diagrams of the LED rechargeable headlamp according to the above preferred embodiment of the present invention, illustrating that the rechargeable dock is mounted on the light head.
Figure 3B:
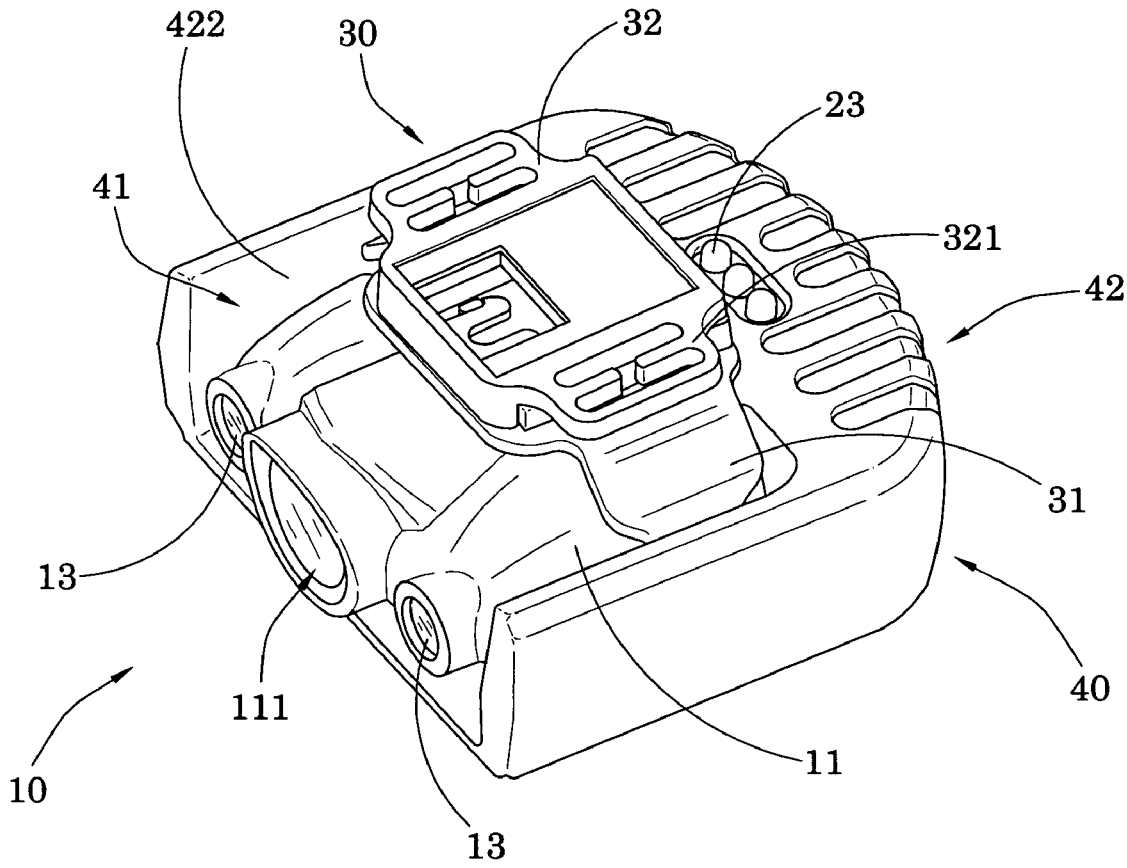
Figure 4:
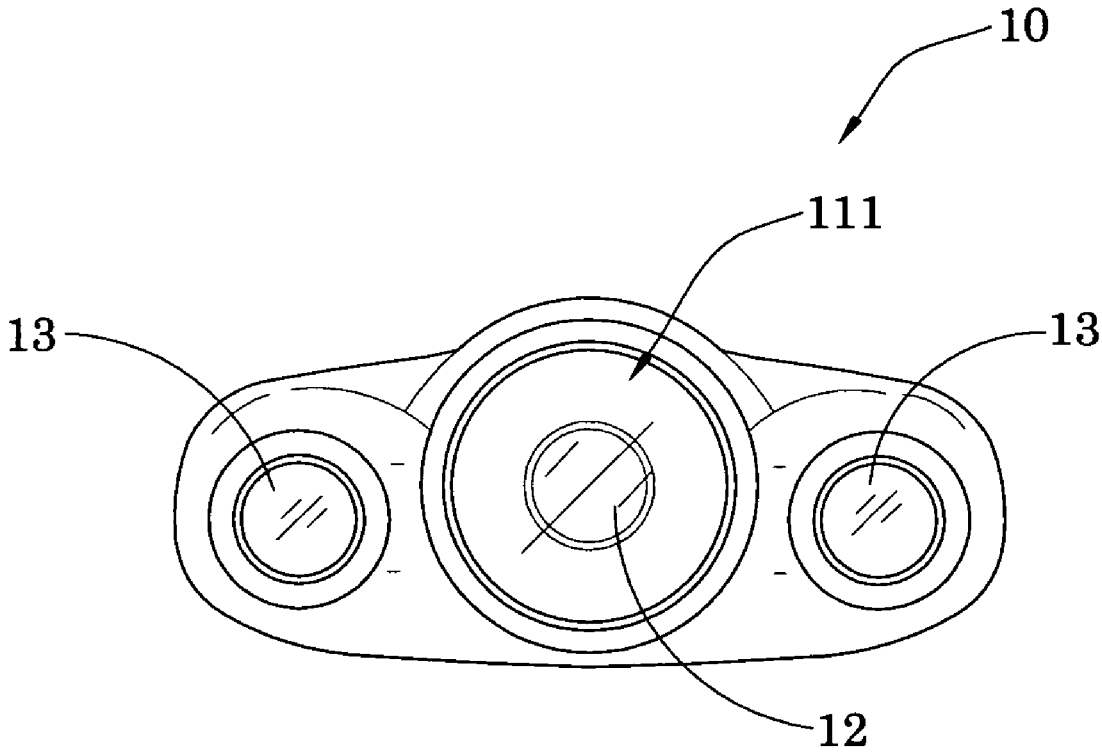
FIG. 4 is a front view of the LED rechargeable headlamp according to the above preferred embodiment of the present invention.

Referring to FIG. 1, FIG. 2A, FIG. 2B, FIG. 3A, FIG. 3B and FIG. 4 of the drawings, a LED rechargeable headlamp according to a preferred embodiment of the present invention is illustrated, in which the LED rechargeable headlamp comprises a light head 10, a rechargeable power source 20, a head mount 30 and a rechargeable dock 40.

The light head 10 comprises a light housing 11 having a light window 111, and a LED light source 12 supported in the light housing 11 to align with the light window 111 so that the LED light source 12 is arranged to deliver illumination to an exterior of the light housing 11 through the light window 111. On the other hand, the rechargeable power source 20 is supported in the light housing 11 to provide electricity to the LED light source for allowing illumination thereof.

The head mount 30 is movably coupled with the light housing 11 to selectively adjust a light projecting orientation of the LED light source 12 through the light window 111. In other words, the adjustable light projecting orientation allows a user to freely control the orientation of the illumination generated by the LED light source 12 for illuminating specific location designated by the user.

The rechargeable dock 40, which is adapted for electrically connecting with an external power supply, such as an external AC power supply, has a docking cavity 41 detachably adapted for receiving the light head 10 to charge the rechargeable power source 20.

According to the preferred embodiment of the present invention, the head mount 30 comprises two retention walls 31 rotatably and pivotally coupling with two sides of the light housing 11 to selectively adjust the light projecting orientation of the LED light source 12, and a mounting panel 32 extended between the retention walls 31 to form a U-shaped member, wherein the light housing 11 is arranged to be freely and pivotally move with respect to the head mount 30 for selectively adjusting the angle of illumination by the LED light source 12. It is worth mentioning that the pivotal coupling between the retention walls 31 and the light housing 11 can be accomplished by various conventional means, such as two screw connectors 33.

In order to allow the light head 10 to be worn on a user's head, the mounting panel 32 is arranged to be attached with a strap or a headband 70 for wearing on the user's head. As a result, the mounting panel 32 has a plurality of band slots 321 spacedly formed thereat for a headband 70 detachably fastening at the mounting panel 32 at the corresponding band slots 321 so as to enable the light head 10 being carried at a head portion of a user via the headband 70. The headband 70 is arranged to be length-adjustable so as to fit differing head sizes of different users. The headband 70 should be made of flexible materials, such as durable fabric or elastic material, for allowing the user to conveniently wear on his or her head and detach the LED rechargeable headlamp from the body. Furthermore, each of the band slots 321 is preferably elongated in shape and is longitudinally and spacedly formed on the mounting panel 32 of the head mount 30 so as to allow the corresponding headband 70 to attach at the band slots 321 in such a manner that the headband 70 is arranged to form a wearing loop 71 adjustable to fittedly receive a user's head, so that the light housing 11 is mounted at a forehead of the user and that the light window 111 is oriented to provide illumination at a front side of the user's forehead, yet with adjustable angle of orientation through pivotal movement of the light housing 11.

On the other hand, the rechargeable power source 20 comprises a rechargeable battery 21 which is preferably embodied as a Li-ion rechargeable battery supported in the light housing 11, and two switch controls 22 spacedly provided at the light housing 11 for controllably switching the LED light source 12 in an on and off manner. As shown in FIG. 1, the two switch controls 22 are spacedly provided on the top side of the light housing 11 for easy accessing.

The rechargeable power source 20 further comprises a charging terminal 24 provided at the bottom side of the light housing 11 to electrically extend from the rechargeable battery 21.

In order to provide better illumination for the LED rechargeable headlamp, the light head 10 further comprises two auxiliary light sources 13 provided at the light housing 11 at a position that the LED light source 12 is positioned between the auxiliary light sources 13, wherein each of the auxiliary light sources 13 has the same light projecting orientation of the LED light source 12 for providing additional light to illuminate a designated area or a targeted object aimed by the LED light source 12. The auxiliary light sources 13 are also electrically connected with the rechargeable power source 20 for acquiring electricity to provide additional lighting performance of the LED rechargeable headlamp. According to the preferred embodiment of the present invention, the LED light source 12 is preferably embodied as an ultra power cree LED bulb while the auxiliary light sources 13 are embodied as white LED bulbs respectively. Together, they provide an optimal level of light directed at a predetermined or a desirable location through adjustment of the light housing 10 with respective to the head mount 30.

It is worth mentioning that the switch controls 22 are arranged to selectively operate the LED light source 12 and/or the auxiliary light sources 13 (i.e. a dual switch control) so that a user is allowed to select which light source (i.e. either the LED light source 12 or at least one of the auxiliary light source 13) or both light sources are to be utilized.

Preferably, one of the switch controls 22 is arranged to switch one of the LED light source 12 and the auxiliary light sources 13 in an on and off manner, while another switch control 22 is arranged to switch between a main light mode and an auxiliary light mode. Accordingly, the main light mode is that the LED light source 12 is activated and the auxiliary light mode is that the auxiliary light sources 13 are activated.

Referring to FIG. 1, FIG. 2A, FIG. 2B, FIG. 3A, FIG. 3B and FIG. 4 of the drawings, the rechargeable power source 20 further comprises a LED charging indicator 23 provided on the rechargeable dock 40 for indicating a status of the rechargeable power source 20. The LED charging indicator 23 can be embodied as at least one LED provided on the rechargeable dock 40 for illuminating a particular color of light to indicate the corresponding charging status. For example, a green light may represent that the rechargeable power source 20 has been fully charged, while a yellow light represents that the rechargeable power source 20 is being properly recharged.

The rechargeable dock 40 comprises a dock body 42 having a docking base 421 and at least one side docking wall 422, preferably two side docking walls, integrally extended from the docking base 421 to form the docking cavity 41 within the docking base 421 and the side docking wall 422. The rechargeable dock 40 further comprises an electric terminal 43 provided within the docking cavity 41 either on the docking base 421 or the side docking wall 422 for electrically connecting the light head 10 with an external power source, such as an external AC power source.

Figure 5:
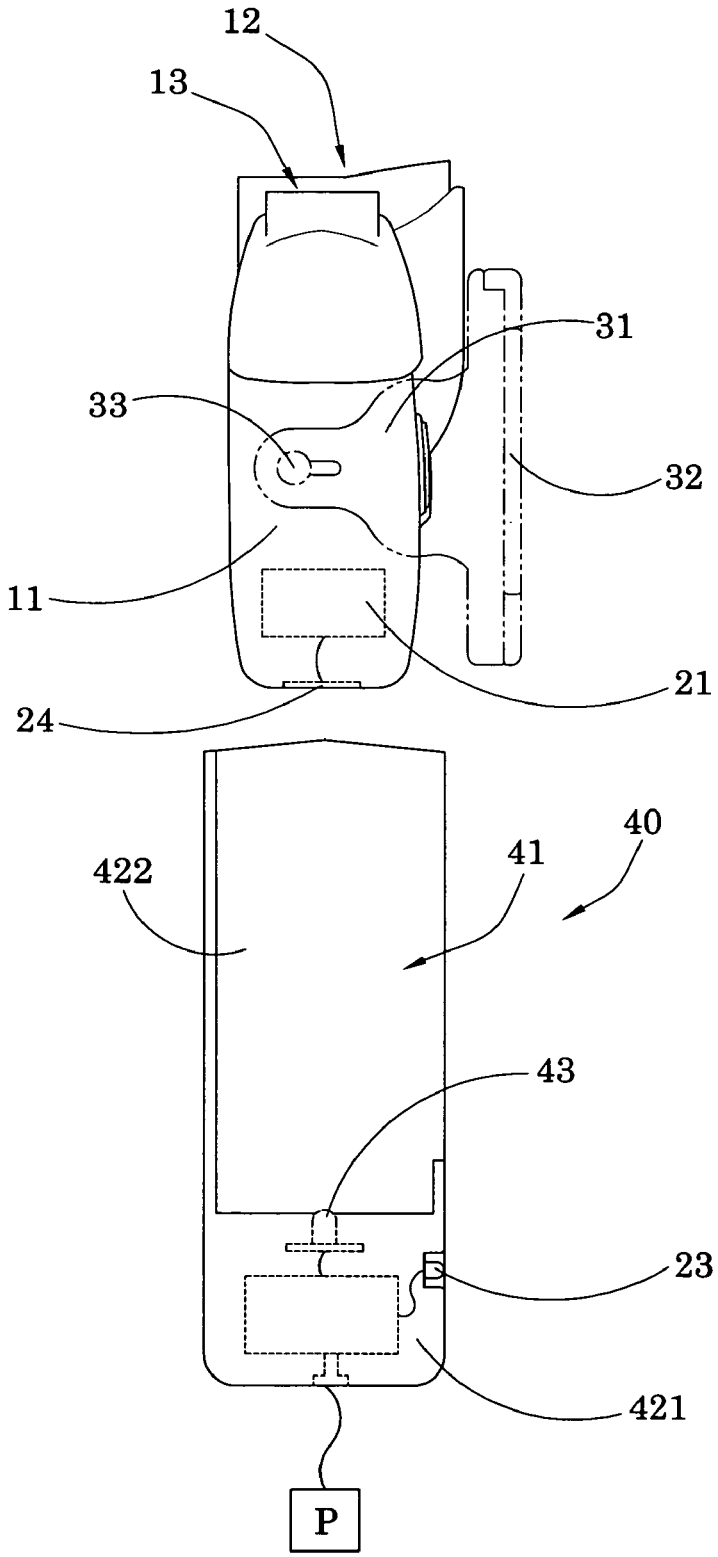
FIG. 5 is a side view of the LED rechargeable headlamp according to the above preferred embodiment of the present invention, illustrating the charging terminal of the light head being contacted with the electric terminal of the rechargeable dock for recharging purpose.

As shown in FIG. 5, the electric terminal 43 is provided at the bottom wall of the docking cavity 41 to electrically contact with the charging terminal 24 of the rechargeable power source 20 when the light housing 11 is disposed within the docking cavity 41 so as to recharge the rechargeable battery 21. It is worth mentioning that the light head 10 can be disposed at the docking cavity 41 of the rechargeable dock 40 without detaching the head mount 30 from the light head 10. In other words, the head mount 30 is pivotally folded at the top side of the light head 10 in order to dispose the light head 10 at the docking cavity 41 of the rechargeable dock 40.

In order to impart wider application of the present invention, the rechargeable dock 40 contains a wall mounting slot 44 provided at the rear side of the rechargeable dock 40 for detachably mounting the rechargeable dock 40 on a wall surface via a fastener, such that when the light head 10 is received in the rechargeable dock 40, the light head 10 forms a wall light for illumination. In addition, the rechargeable dock 40 can be suspendedly hung on the wall surface to recharge the rechargeable battery 21 when the light head 10 is disposed at the rechargeable dock 40.

The light housing 11 and the head mount 30 and the rechargeable dock 40 are preferably made of durable yet reasonably light materials such as ABS plastic for allowing the user to utilize the present invention in a wide variety of circumstances.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A LED rechargeable headlamp, comprising:

a light head comprising a light housing having a light window, and a LED light source supported in said light housing to align with said light window;

a rechargeable power source supported in said light housing;

a head mount movably coupling with said light housing to selectively adjust a light projecting orientation of said LED light source through said light window, wherein said head mount comprises two retention walls rotatably coupling with two sides of said light housing to selectively adjust said light projecting orientation of said LED light source, and a mounting panel extended between said retention walls to form a U-shaped member, wherein said mounting panel has a plurality of band slots spacedly formed thereat for a headband detachably fastening at said mounting panel so as to enable said light head being carried at a head portion of a user via said headband; and a rechargeable dock, which is adapted for electrically connecting with an external power supply, having a docking cavity detachably receiving said light head to charge said rechargeable power source, wherein said rechargeable dock and said head mount are coupled with said light head to form a single compact unit, wherein when said light head is charged at said rechargeable dock, said head mount is remained coupled with said light head such that said light head is ready to use for being worn when said light head is removed from said rechargeable dock;

wherein said head mount is pivotally coupled with said light head to enable said light head being freely and adjustably controlled said light projecting orientation of said LED light source when said light head is worn, wherein said head mount is pivotally folded on said light head to allow said light head being received at said docking cavity in order to electrically charge said rechargeable power source;

wherein said light head further comprises two auxiliary light sources provided at said light housing at a position that said LED light source is positioned between said auxiliary light sources, wherein each of said auxiliary light sources has the same light projecting orientation of said LED light source, wherein said LED light source and said auxiliary light sources have different light properties;

wherein said rechargeable power source comprises a rechargeable battery supported in said light housing and two switch controls spacedly provided at said light housing for controllably switching said LED light source and said auxiliary light sources in an on and off manner, wherein one of said switch controls is arranged to switch one of said LED light source and said auxiliary light sources in an on and off manner, while another said switch control is arranged to switch between a main light mode and an auxiliary light mode, wherein said main light mode is that said LED light source is activated and said auxiliary light mode is that said auxiliary light sources are activated;

wherein said rechargeable dock comprises a dock body having a docking base and two side docking walls integrally extended from said docking base to form said docking cavity within said docking base and said side docking walls, wherein said rechargeable dock further comprises an electric terminal provided at a bottom wall of said docking cavity to electrically contact with said rechargeable power source when said light head is disposed at said docking cavity for recharging purpose, wherein said light head forms a wall light for illumination that said LED light source provides an upward light projecting orientation when said light head is disposed at said docking cavity.

2. The LED rechargeable headlamp, as recited in claim 1, wherein said rechargeable power source further comprises a charging terminal provided at a bottom side of said light head to electrically contact with said electric terminal of said rechargeable dock, wherein when said light head is slidably disposed at said docking cavity of said rechargeable dock until said bottom side of said light head contacts with said bottom wall of said docking cavity, said charging terminal is electrically contacted with said electric terminal for recharging operation.

3. The LED rechargeable headlamp, as recited in claim 2, wherein said rechargeable power source further comprises a LED charging indicator provided on said rechargeable dock for indicating a status of said rechargeable power source, and a wall mounting slot provided at a rear side of said rechargeable dock for detachably mounting said rechargeable dock on a wall surface via a fastener.

* * * * *